US009322173B2

(12) United States Patent
Pisani

(10) Patent No.: US 9,322,173 B2
(45) Date of Patent: Apr. 26, 2016

(54) LIGHTWEIGHT SHINGLE ASSEMBLY

(71) Applicant: Michael Pisani, Walnut Creek, CA (US)

(72) Inventor: Michael Pisani, Walnut Creek, CA (US)

( * ) Notice: Subject to any disclaimer, the term of this patent is extended or adjusted under 35 U.S.C. 154(b) by 0 days.

(21) Appl. No.: 14/614,657

(22) Filed: Feb. 5, 2015

(65) Prior Publication Data

US 2015/0218817 A1 Aug. 6, 2015

Related U.S. Application Data

(60) Provisional application No. 61/935,942, filed on Feb. 5, 2014.

(51) Int. Cl.

| | |
|---|---|
| ***E04D 1/00*** | (2006.01) |
| ***E04D 1/14*** | (2006.01) |
| ***E04D 1/18*** | (2006.01) |
| ***E04D 1/28*** | (2006.01) |

(52) U.S. Cl.

CPC .. *E04D 1/14* (2013.01); *E04D 1/18* (2013.01); *E04D 1/28* (2013.01); *Y10T 29/49826* (2015.01); *Y10T 428/24008* (2015.01)

(58) Field of Classification Search

CPC ..... E04D 1/20; E04D 1/265; E04D 1/34; E04D 2001/3414; E04D 2001/3491

USPC ..... 52/518, 544, 549, 519, 520

See application file for complete search history.

(56) References Cited

U.S. PATENT DOCUMENTS

| | | | | | |
|---|---|---|---|---|---|
| 1,463,482 | A | * | 7/1923 | Mountford | 52/547 |
| 2,106,624 | A | * | 1/1938 | Ray | 428/126 |
| 2,253,105 | A | * | 8/1941 | Bill | 52/556 |
| 3,943,677 | A | * | 3/1976 | Carothers | 52/309.4 |
| 4,120,132 | A | * | 10/1978 | Kendrick | 52/478 |
| 4,391,076 | A | * | 7/1983 | Ferguson | 52/553 |
| 4,884,932 | A | * | 12/1989 | Meyer | 411/373 |
| 5,070,671 | A | * | 12/1991 | Fifield et al. | 52/533 |
| 5,295,339 | A | * | 3/1994 | Manner | 52/518 |
| 5,305,569 | A | * | 4/1994 | Malmquist et al. | 52/309.8 |
| 5,711,126 | A | * | 1/1998 | Wells | 52/519 |
| 5,946,877 | A | * | 9/1999 | Gallinat et al. | 52/543 |
| 6,021,611 | A | * | 2/2000 | Wells et al. | 52/98 |
| 6,151,859 | A | * | 11/2000 | Nowacek | 52/518 |
| 6,164,034 | A | * | 12/2000 | Roetheli et al. | 52/560 |
| 6,470,642 | B1 | * | 10/2002 | Eads | 52/518 |
| 7,934,346 | B2 | * | 5/2011 | MacKinnon et al. | 52/554 |
| 8,006,456 | B1 | * | 8/2011 | Green et al. | 52/547 |
| 8,061,102 | B2 | * | 11/2011 | Turek et al. | 52/560 |
| 8,667,758 | B2 | * | 3/2014 | Fernandez Fernandez | 52/543 |
| 8,915,030 | B2 | * | 12/2014 | Boven et al. | 52/173.3 |
| 2004/0148895 | A1 | * | 8/2004 | Jolitz et al. | 52/518 |
| 2006/0029775 | A1 | * | 2/2006 | MacKinnon et al. | 428/141 |
| 2008/0185748 | A1 | * | 8/2008 | Kalkanoglu | 264/46.6 |
| 2010/0037548 | A1 | * | 2/2010 | Kalkanoglu et al. | 52/309.1 |
| 2010/0146898 | A1 | * | 6/2010 | Pierson et al. | 52/549 |
| 2010/0170169 | A1 | * | 7/2010 | Railkar et al. | 52/173.3 |

(Continued)

*Primary Examiner* — Basil Katcheves
*Assistant Examiner* — Joshua Ihezie
(74) *Attorney, Agent, or Firm* — Risso & Associates

(57) ABSTRACT

Described is a lightweight shingle assembly (LSA). The LSA is formed of a fastening portion that is secured with a shingle portion. The shingle portion is any weather resistant shingle material, such as slate, granite, limestone, etc., while the fastening portion is a lightweight and weather resistant material, such as aluminum sheet metal. Further, an insulating support can be positioned within the fastening portion to further support and insulate the LSA. Thus, the LSA provides lower roofing weight loads than solid material shingles with the same appearance and function.

4 Claims, 13 Drawing Sheets

(56) References Cited

U.S. PATENT DOCUMENTS

2010/0192499 A1* 8/2010 Bryson et al. ..... 52/540
2013/0031864 A1* 2/2013 Schools et al. ..... 52/519
2013/0095958 A1* 4/2013 Solheim et al. ..... 473/406
2013/0137346 A1* 5/2013 Toncelli ..... 451/150
2014/0193610 A1* 7/2014 Huber ..... 428/141

* cited by examiner

LIGHTWEIGHT SHINGLE ASSEMBLY

CROSS-REFERENCE TO RELATED APPLICATIONS

The present application is a Non-Provisional Utility patent application of U.S. Provisional Application No. 61/935,942, filed on Feb. 5, 2014, entitled, "Lightweight Shingle Assembly (LSA)."

BACKGROUND OF THE INVENTION (1) Field of Invention

The present invention relates to roofing shingles and, more particularly, to a lightweight insulated stone roofing shingle assembly.

(2) Description of Related Art

The use of natural slate, stone, clay, ceramic, or terracotta as a roofing medium goes back several centuries. These materials by their nature are relatively heavy when compared to other roofing materials such as wood and asphalt. The excessive weight of such shingles limits use of these materials to structures specifically designed to support heavier roof loads. Although a variety of stone and other materials have been used as roofing shingles, slate and similar stones are long known as the leading material varieties available. It should be noted that for convenience purposes, the term "slate" is being used herein to refer to any type of roofing material, such as stone, porcelain, clay, ceramic, terracotta, etc. Slate is a unique geological material possessing certain inherent strengths and weathering characteristics enabling it to withstand severe environmental elements for many decades and, in some cases, centuries. A good roofing slate will have a low water absorption rate, high weathering resistance from exposure to sun and chemical attack from rain, be unaffected by freeze thaw cycles, and possess an ability to not easily break when subject to flexural loads.

Installation labor costs are widely known to be higher for slate roofs than for other roofing products due to three key factors, including: (1) weight of material, (2) method of installation, and (3) handling breakage. Slate roofing materials can weigh several times that of other roofing materials, such as composite or asphalt shingles. The added weight of slate roofing materials means that there is more weight to lift, move, handle, and install, all of which add cost and risk. Further, roofing slates are typically drilled or punched with two holes for installation. Installed slates hang on two nails that have been hammered into the roofing substrate by the installer. The process of vertically holding a slate in place while positioning nails, then nailing carefully so as to not hit the slate is difficult. The nailing process results in 1%-2% loss due to damage from inadvertent hammer blows. Additionally, automatic fastening guns cannot be used on slate shingles due to damage from impact forces, further slowing install time.

Thus, a continuing need exists for a lightweight shingle assembly that is easier to install than traditional slate shingles and less prone to breakage during installation and handling.

SUMMARY OF INVENTION

The present invention relates to a lightweight shingle assembly (LSA). The LSA includes a shingle portion and a fastening portion affixed with the shingle portion. Due to the lightweight assembly and unique components, an installer can easily affix the fastening portion with a roof and thereby affix the shingle portion with the roof.

In another aspect, the fastening portion is formed of a material that is dissimilar to a material forming the shingle portion.

In yet another aspect, the shingle portion includes a connector section and a shingle section, such that each of the connector section and shingle section have a width and height profile, with the connector section having a width and height that is less than the width and height of the shingle section.

Additionally and in one aspect, the fastening portion is formed of an aluminum sheet, with fold-over sides that are adapted to wrap around the connector section of the shingle portion.

Further, double counter sunk holes are formed in the connector section.

In another aspect, offset washers are positioned in the double counter sunk holes of the connector section.

In yet another aspect, the fastening portion is affixed with the shingle portion with rivets that pass through holes in the fold-over sides and through the offset washers.

Additionally, an insulating support is positioned within the fastening portion. In one aspect, the insulating support is an expandable foam material.

In yet another aspect, the shingle portion is formed of a stone material.

Finally, as can be appreciated by one in the art, the present invention also comprises a method for forming and using the invention described herein.

BRIEF DESCRIPTION OF THE DRAWINGS

The objects, features and advantages of the present invention will be apparent from the following detailed descriptions of the various aspects of the invention in conjunction with reference to the following drawings, where.

DETAILED DESCRIPTION

Figure 1:
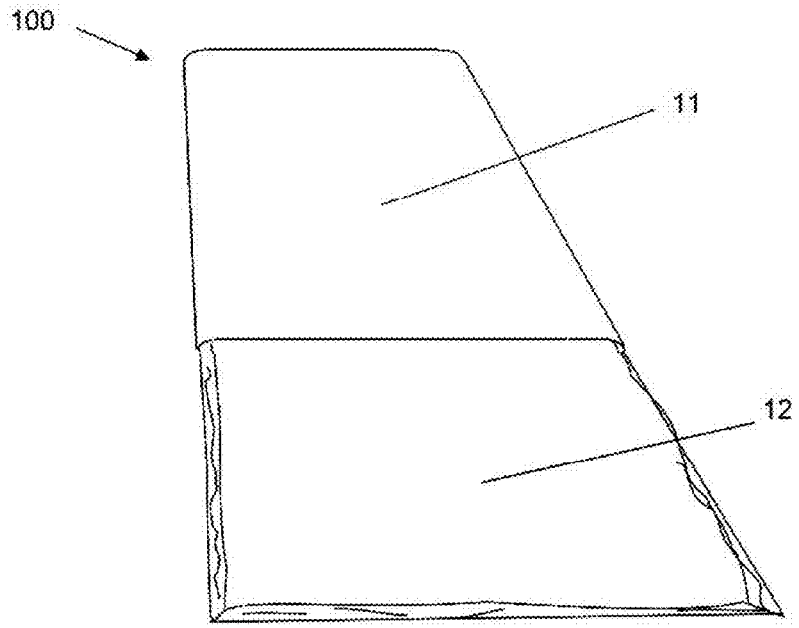
FIG. 1 is a front, bottom-view illustration of a lightweight shingle assembly (LSA) according to the principles of the present invention, depicting a fastening portion and a shingle portion.

The present invention relates to roofing shingles and, more particularly, to a lightweight insulated stone roofing shingle assembly. The following description is presented to enable one of ordinary skill in the art to make and use the invention and to incorporate it in the context of particular applications. Various modifications, as well as a variety of uses in different applications will be readily apparent to those skilled in the art, and the general principles defined herein may be applied to a wide range of embodiments. Thus, the present invention is not intended to be limited to the embodiments presented, but is to be accorded the widest scope consistent with the principles and novel features disclosed herein.

In the following detailed description, numerous specific details are set forth in order to provide a more thorough understanding of the present invention. However, it will be apparent to one skilled in the art that the present invention may be practiced without necessarily being limited to these specific details. In other instances, well-known structures and devices are shown in block diagram form, rather than in detail, in order to avoid obscuring the present invention.

The reader's attention is directed to all papers and documents which are filed concurrently with this specification and which are open to public inspection with this specification, and the contents of all such papers and documents are incorporated herein by reference. All the features disclosed in this specification, (including any accompanying claims, abstract, and drawings) may be replaced by alternative features serving the same, equivalent or similar purpose, unless expressly stated otherwise. Thus, unless expressly stated otherwise, each feature disclosed is only one example of a generic series of equivalent or similar features.

Furthermore, any element in a claim that does not explicitly state "means for" performing a specified function, or "step for" performing a specific function, is not to be interpreted as a "means" or "step" clause as specified in 35 U.S.C. Section 112, Paragraph 6. In particular, the use of"step of" or "act of" in the claims herein is not intended to invoke the provisions of 35 U.S.C. 112, Paragraph 6.

Please note, if used, the labels left, right, front, back, top, bottom, forward, reverse, clockwise and counter clockwise have been used for convenience purposes only and are not intended to imply any particular fixed direction. Instead, they are used to reflect relative locations and/or directions between various portions of an object. Although not limited thereto, the term "front" with respect to the lightweight shingle assembly (LSA) generally refers to the face of the LSA that would be exposed to elements when installed on a roof, with the other labels reflecting a corresponding relative labeling.

Before describing the invention in detail, first an introduction provides the reader with a general understanding of the present invention. Thereafter, specific details of the present invention are provided to give an understanding of the specific aspects.

(1) Introduction

As noted above, described is a lightweight shingle assembly (LSA) that is easier to install than traditional slate shingles and less prone to breakage during installation and handling. The LSA is formed of a fastening portion (e.g., anodized aluminum sheet) that is mechanically attached (e.g., via rivets, fasteners, or formed attachment) to a shingle portion (e.g., roofing slate). The LSA provides for a lightweight insulated slate (e.g., stone) roofing shingle assembly that has the same appearance and weatherproofing functions similar to other comparably sized and solid stone roofing shingles. Since the weight of the LSA is significantly less than a solid one-piece slate shingle, there is less weight to lift, move, handle, and install. For example, each LSA weighs approximately 60 percent of that of a traditional slate shingle, resulting in a 40 percent reduction in roof weight requirements. As the average weight per square of solid stone shingles typically exceeds 900 pounds/square foot, a 40 percent reduction reduces the average weight per square to less than 600 pounds/square foot. This weight reduction opens up additional installation opportunities in both new installations and in re-roofing, where weight limitations limit what type of roofing material can be employed. It can be installed using pneumatic or automatic fastening equipment. The fasteners can be nail or staple type and, further reduce installed weight per square. The use of such fastening equipment greatly increases the productivity of the installation process. Furthermore, the ability to use pneumatic fastening equipment offers a simpler mechanical operation that does not require highly skilled craftsman. A faster install speed using lesser skilled installers results in significant labor cost reductions.

Along with the weight advantage and automatic fastening suitability, the LSA includes a unique foam-filled aluminum upper panel (i.e., fastening portion) that provides additional insulation and unit flexibility. This flexibility reduces product loss resulting from breakage due to bending stresses from handling and installation operations. The fastening portion further allows for an expanded use of stone, glass, concrete or clay products not previously considered suitable as roofing elements due to weight, attachment, or strength characteristics. Further, typical standard slate product losses resulting from mishandling and installation operations often exceed 10 percent. The LSA according to the principles of the present invention significantly decreases such losses resulting in comparable product and associated labor cost savings. Thus, the LSA enables the use of a variety of products where weight or attachment method is a limiting factor; reduces installation costs by making the installation process easier; and reduces product costs and losses from handling and installation operations. Specific aspects of the LSA are described in further detail below.

(2) Specific Aspects

As shown in FIG. 1, described is a lightweight shingle assembly (LSA) 100 formed of a fastening portion 11 and a shingle portion 12. The fastening portion 11 is formed of any suitably strong, yet lightweight material that can be used to affix the shingle portion 12 with a roof. In a desired aspect, the fastening portion 11 is formed of dissimilar material than the shingle portion 12. For example, the fastening portion 11 is formed of a sheet metal, a non-limiting example of which includes an aluminum sheet that is anodized or painted to minimize corrosion. The shingle portion 12 on the other hand operates as the shingle face that is exposed to the weather elements and must be stable and weather resistant. The shingle portion 12 is formed of any suitable roofing material, non-limiting examples of which include stone, claim, ceramic, terracotta, glass, metal, etc.

Figure 2:
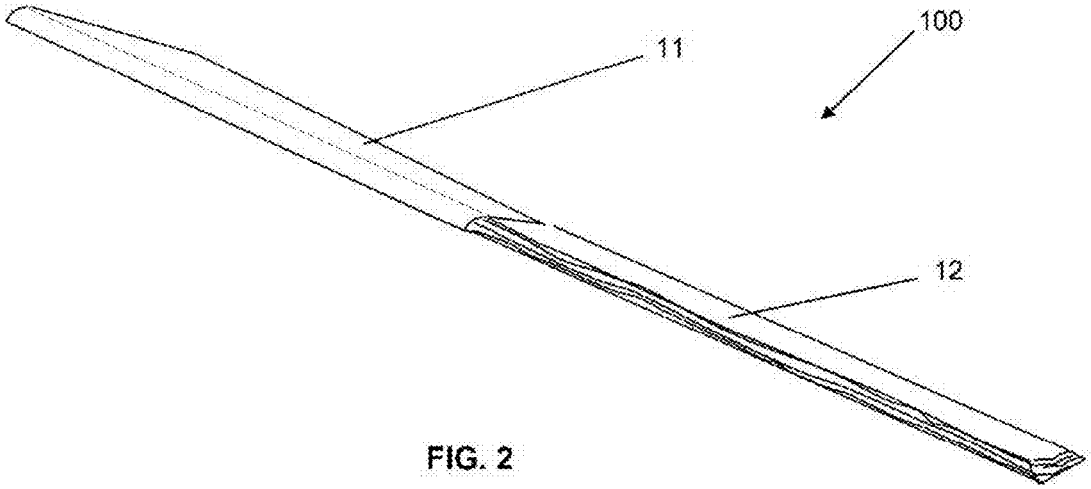
FIG. 2 is a left, side-view illustration of the LSA according to the principles of the present invention, showing the fastening portion and the shingle portion.
Figure 3:
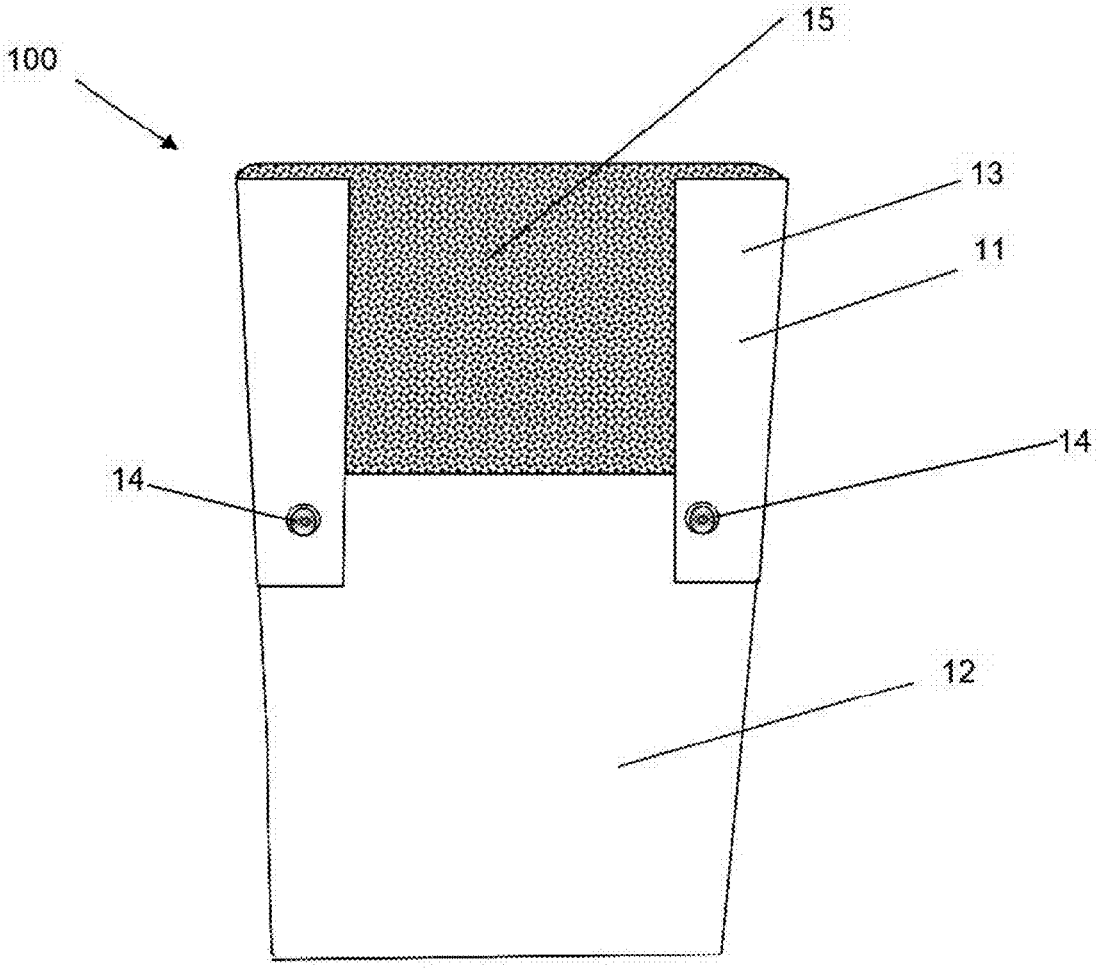
FIG. 3 is a rear, top-view illustration of the LSA according to the principles of the present invention, depicting the fastening portion affixed with the shingle portion, along with an insulating support embedded within the fastening portion.
Figure 4:
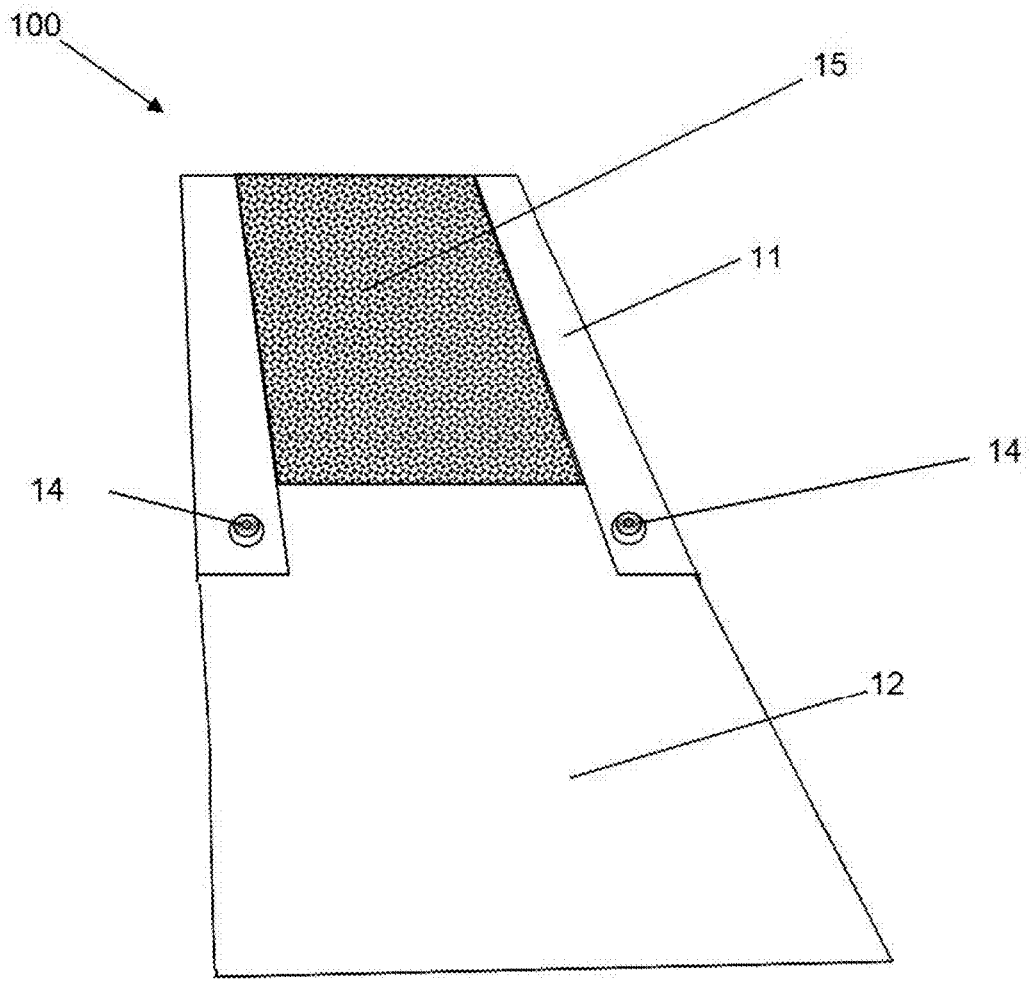
FIG. 4 is a rear, bottom-view illustration of the LSA according to the principles of the present invention, depicting the fastening portion affixed with the shingle portion, along with the insulating support embedded within the fastening portion.

For further understanding, FIG. 2 is a side-view illustration of the LSA 100, showing the shingle portion 12 affixed with the fastening portion 11. The shingle portion 12 is affixed with the fastening portion 11 using any suitable method or technique for affixing two components with one another, a non-limiting example of which is shown in FIG. 3, which depicts a rivet 14 as attaching the two components. FIG. 3 is a rear-view illustration of the LSA 100, which shows the fastening portion 11 as having fold-over sides 13 wrapped around the shingle portion 12 and permanently affixed via the rivet 14. Also depicted is an insulating support 15 that is attached with the fastening portion 11. The insulating support 15 is attached with the fastening portion 11 using any suitable mechanism or technique. As a non-limiting example, the insulating support 15 is a foam that is embedded (as an expanding foam) within the fastening portion 11. For further understanding, FIG. 4 provides another illustration of the LSA 100, showing the insulating support 15 attached with the fastening portion 11, with the fastening portion 11 affixed with the shingle portion 12 via the rivet 14.

Figure 5:
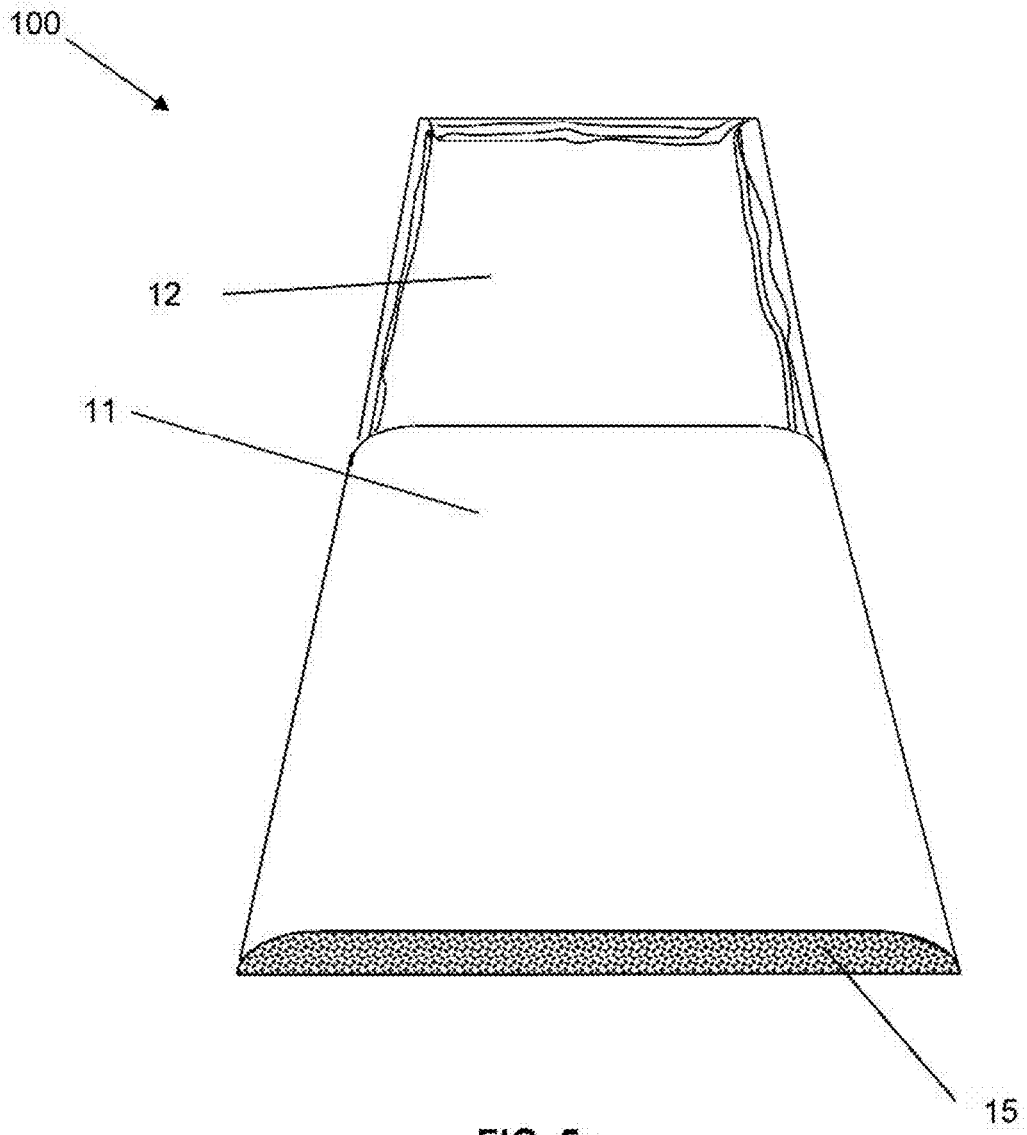
FIG. 5 is a front, top-view illustration of the LSA according to the principles of the present invention, depicting a radius rounding of the fastening portion as wrapped around the insulating support.

FIG. 5 provides another view of the SLA 100, depicting a front, top-view illustration. As shown, the fastening portion 11 is wrapped around the insulating support 15, with the shingle portion 12 projecting from the fastening portion 11. As shown in this front, top-view illustration, the insulating support 15 fills in the fastening portion 11 to both provide insulating and support properties to the fastening portion 11 (which would otherwise be a hollow and unsupported metal hull, as shown in FIGS. 6 and 7).

Figure 6:
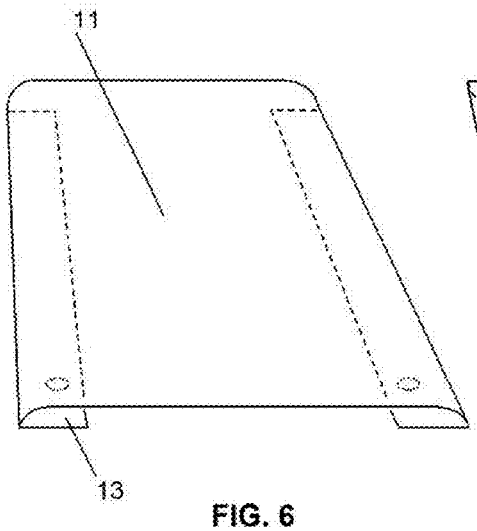
FIG. 6 is a front-view illustration of the fastening portion, depicting the fold-over sides and relative dimensioning.
Figure 7:
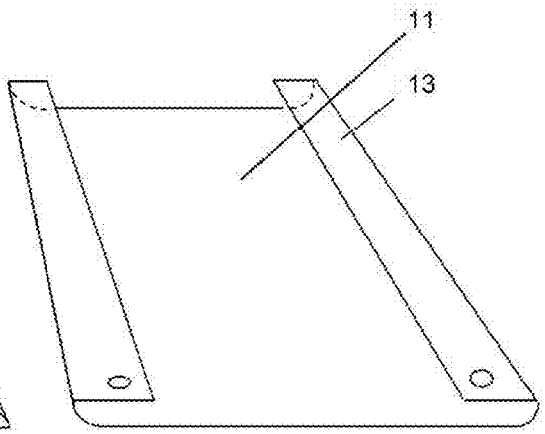
FIG. 7 is a rear-view illustration of the fastening portion.

FIGS. 6 and 7 are front-view and rear-view illustrations, respectively, of the fastening portion 11. In one aspect, the fastening portion 11 is simply a flattened metal sheet that is affixed with the shingle portion; however, in another aspect and as shown, the fastening portion 11 has a three-dimensional shape to accommodate the shingle portion and insulating support. In one aspect and as shown, the fold-over sides 13 are wrapped around to provide shape and support to the insulating support and shingle portion.

Figure 8A:
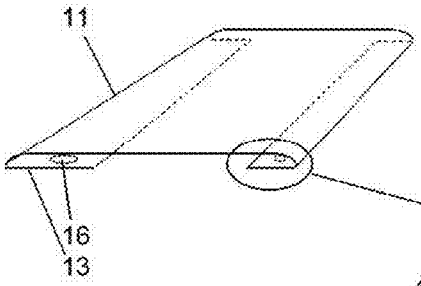
FIG. 8A is a perspective-view illustration of the fastening portion according to the principles of the present invention.
Figure 8B:
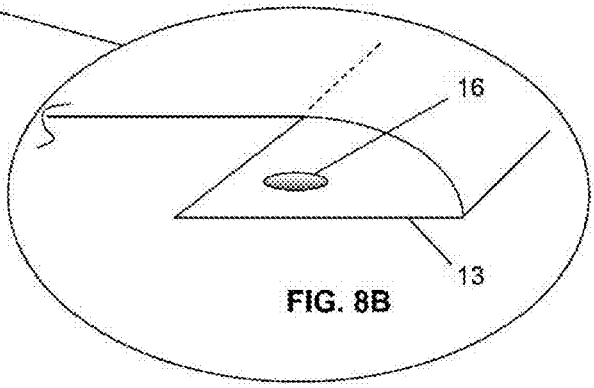
FIG. 8B is an enlarged-view illustration of the fastening portion, depicting a right-side, inside radius and an attaching hole location.

For further understanding, FIG. 8A is a perspective-view illustration of the fastening portion 11 while FIG. 8B is an enlarged-view of the fastening portion 11. As shown, fold-over sides 13 can be formed with attaching holes 16 therethrough. The attaching holes 16 accommodate the aforementioned rivet (or other suitable fixture device) for attaching the shingle portion with the fastening portion 11. The enlarged view of FIG. 8B depicts a right-side, inside radius and an attaching hole 16 as formed on the fold-over side 13.

Figure 9:
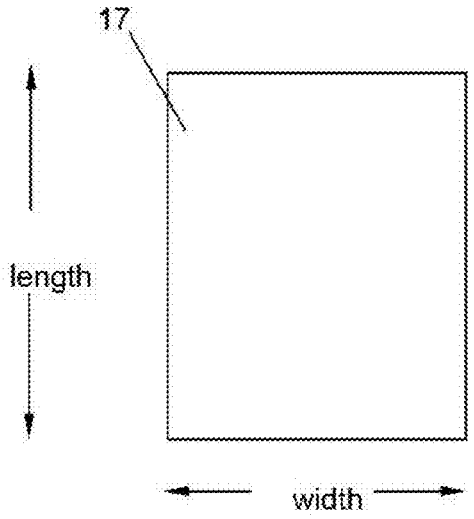
FIG. 9 is a front, plan-view illustration of the fastening portion.

As noted above, the fastening portion 11 can be formed in any desired shape and of any material that is suitable for affixing the shingle portion with a roof and that is of lighter weight than the shingle portion, non-limiting examples of suitable materials include aluminum, copper, stainless steel, or any minimally corrosive metal, carbon fiber, fiberglass, and plastic. In one non-limiting example and as shown in FIG. 9, the fastening portion is desirably formed of sheet metal 17 (e.g., aluminum or any other metal or material), such as a T6 aluminum alloy sheet that is manufactured from 0.016 inch thick 6061 aluminum. The aluminum can be treated for durability, for example, to Type III Hardcoat anodized (Mil spec 8625). In this example, the aluminum material is supplied as a flat sheet 17 that is sheared to dimension. The dimensions are any suitable dimensions. Desirably, the length of the aluminum or attachment material be at least the ½ the length of the finished assembly plus 2"allowing for overlap and attachment area, and width be 3" greater than the finished assembly allowing for overlap and attachment area.

Figure 10:
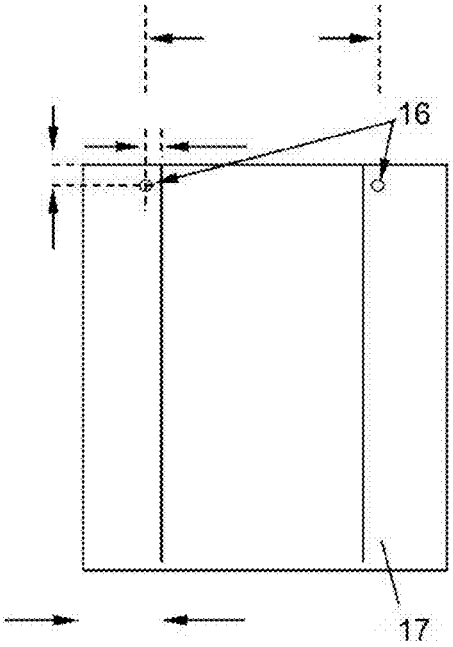
FIG. 10 is a rear, plan-view illustration of the fastening portion.
Figure 11:
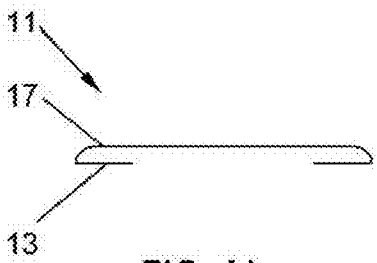
FIG. 11 is a bottom-view illustration of the fastening portion.
Figure 12:
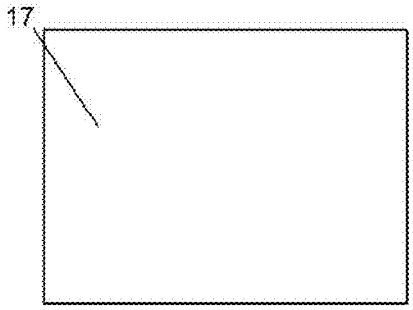
FIG. 12 is a plan-view illustration, depicting a process of forming the fastening portion according to the principles of the present invention, showing an aspect where the fastening portion is shape stamped from a sheet of material.

Thereafter and as shown in FIG. 10, attachment holes 16 can be formed through the sheet 17. The attachment holes 16 can be drilled, punched, or formed through any other suitable technique. Notably, placement of the attachment holes 16 allow for alignment of prepositioned attachment holes in the slate. The sheet 17 is then be press formed to fold the sheet 17 over a profile and, thereby form the fastening portion 11 with its fold-over sides 13. This is further illustrated in FIGS. 12 through 17.

Figure 13:
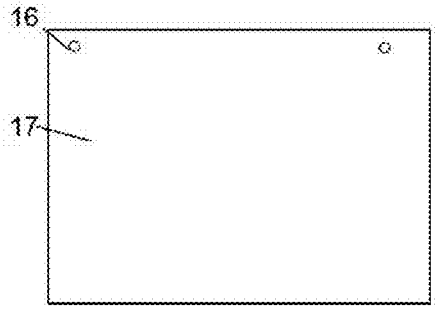
FIG. 13 is a plan-view illustration, depicting the process of forming the fastening portion and showing an aspect where holes are punched through the shape stamped sheet of FIG. 12.
Figure 14:
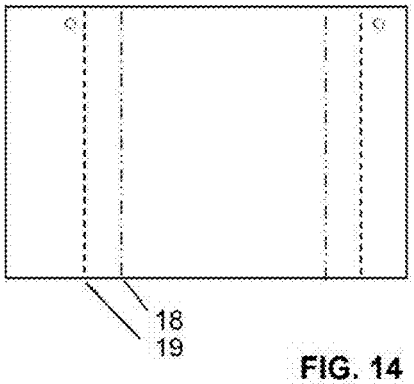
FIG. 14 is a plan-view illustration, depicting the process of forming the fastening portion and showing where fold-over sides are created by forming bends in the shape stamped sheet.
Figure 15:
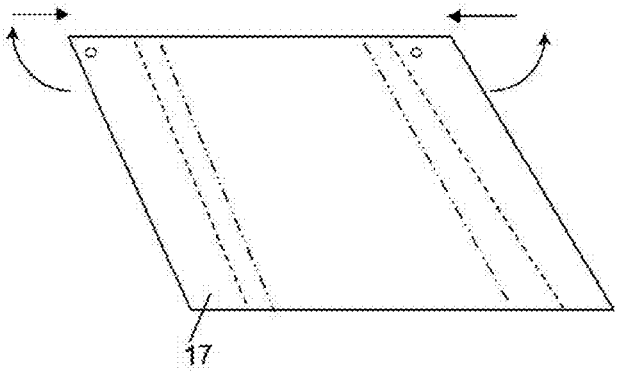
FIG. 15 is a perspective-view illustration, depicting the process of forming the fastening portion and showing the location and direction of forming the bends.
Figure 16:
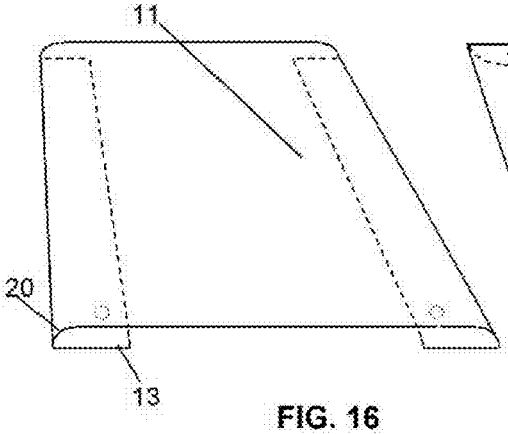
FIG. 16 is a front, perspective-view illustration of the fastening portion, showing the fastening portion with the fold-over sides.
Figure 17:
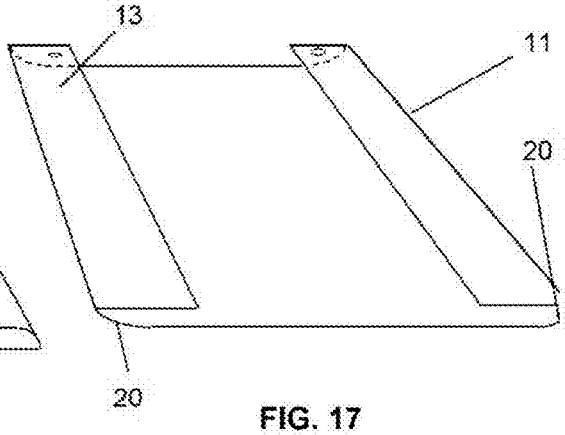
FIG. 17 is a rear, perspective-view illustration of the fastening portion, showing the fastening portion with the fold-over sides.

As noted above and as shown in FIG. 12, the fastening portion can be formed by shape stamping sheet metal to form a sheet 17 of material. Thereafter (or before if desired) and as shown in FIG. 13, holes 16 are punched through the shape stamped sheet 17. As shown in FIG. 14, the fold-over sides are formed by creating bends in the sheet 17. Any desired number and shape of bends can be formed. Desirably, a first bend 18 and second bend 19 are formed. The use of two bends allows for formation of a quarter radius to match and receive the shingle portion. In this example, the first bend 18 indicates a start or initiation of the quarter radius, whereas the second bend 19 indicates an end of the quarter radius and the fold line that is used to form the fold-over side. FIG. 15 illustrates bending of the sheet 17 to form the fastening portion 11 and the corresponding fold-over sides 13 as depicted in FIGS. 16 and 17. Notably, the quarter radii 20 are also illustrated.

To be contrasted with FIGS. 12 through 17, FIGS. 18 through 21 illustrate formation of the shingle portion 12.

Although the term "slate" is used for convenience purposes, it is to be understood that the shingle portion is formed of any suitable weather resistant material, including but not limited to slate, shale, granite, gneiss, marble, limestone, dolomite, travertine, onyx, sandstone, quartz, quartzite, or any natural stone, cement, cementious resin, quartz resin, any synthetic product, porcelain, ceramic, glass, metal, plastic, rubber, wood, clay, terracotta, or any other material. Some materials, such as glass or solar shingles, allow for additional properties that can be employed. For example, added benefits to attaching glass allows for end lighting effects, advertising, and signage. Solar cell shingles can also be formed and utilized as the shingle portion 12.

Figure 18:
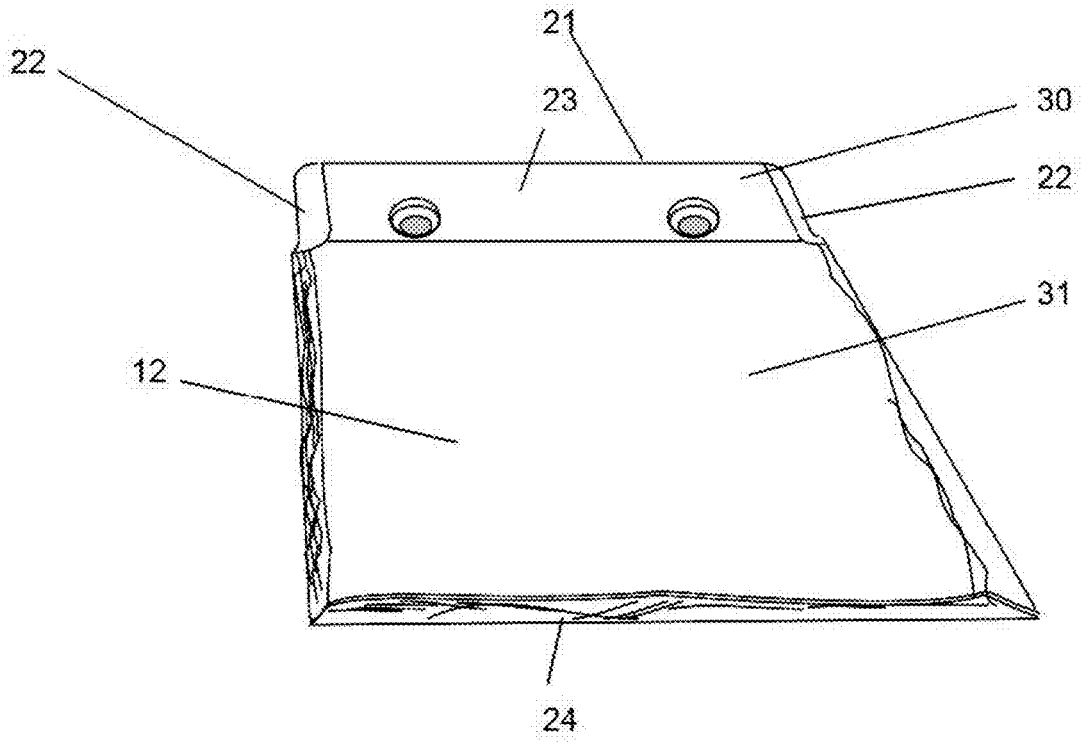
FIG. 18 is a front, bottom-view illustration of the shingle portion according to the principles of the present invention, depicting machined surfaces and countersunk attachment hole placement.
Figure 19:
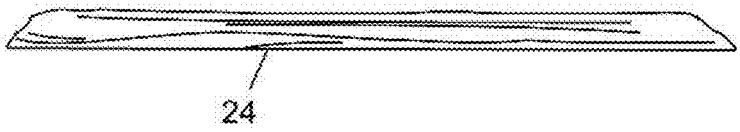
FIG. 19 is a bottom-view illustration of the shingle portion.
Figure 20:
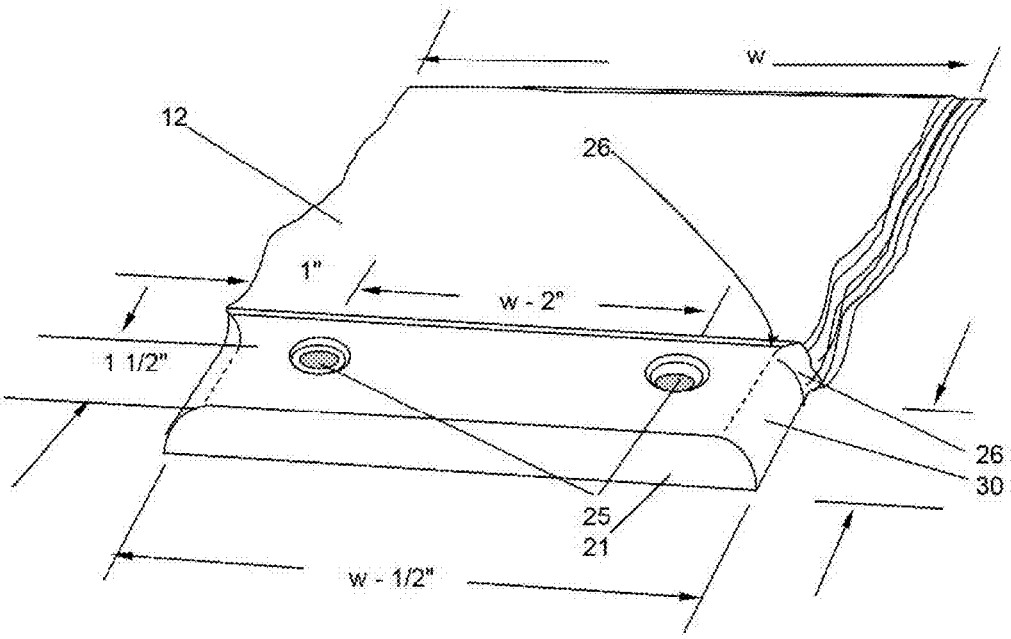
FIG. 20 is a front, top-view illustration of the shingle portion according to the principles of the present invention, depicting machined surfaces and countersunk attachment hole placement.
Figure 21:
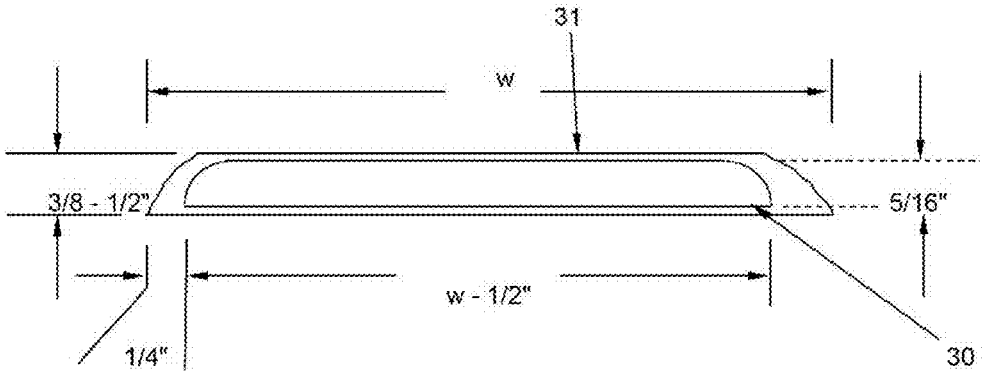
FIG. 21 is top-view illustration of the shingle portion according to the principles of the present invention.
Figure 22:
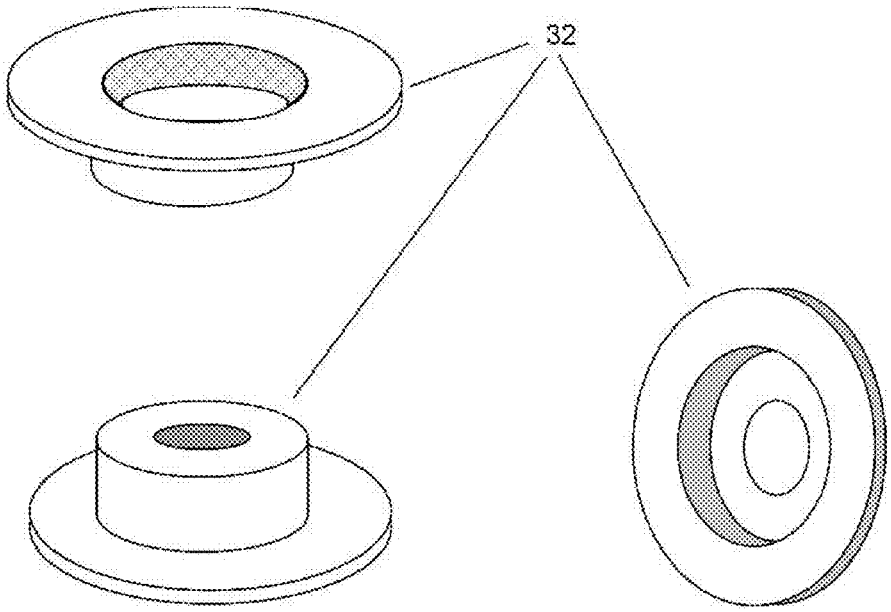
FIG. 22 is an illustration depicting various view-points of an offset washer as used in attaching the shingle portion with the fastening portion according to the principles of the present invention.
Figure 23:
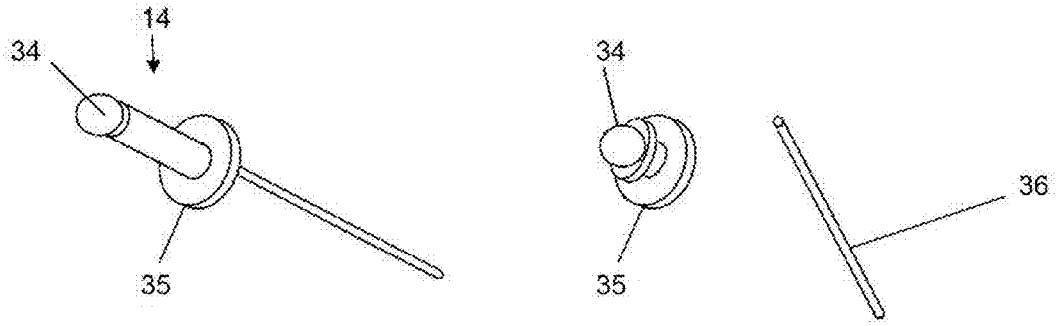
FIG. 23 is an illustration depicting an attachment rivet prior to assembly and as collapsed as it would appear after assembly.
Figure 24:
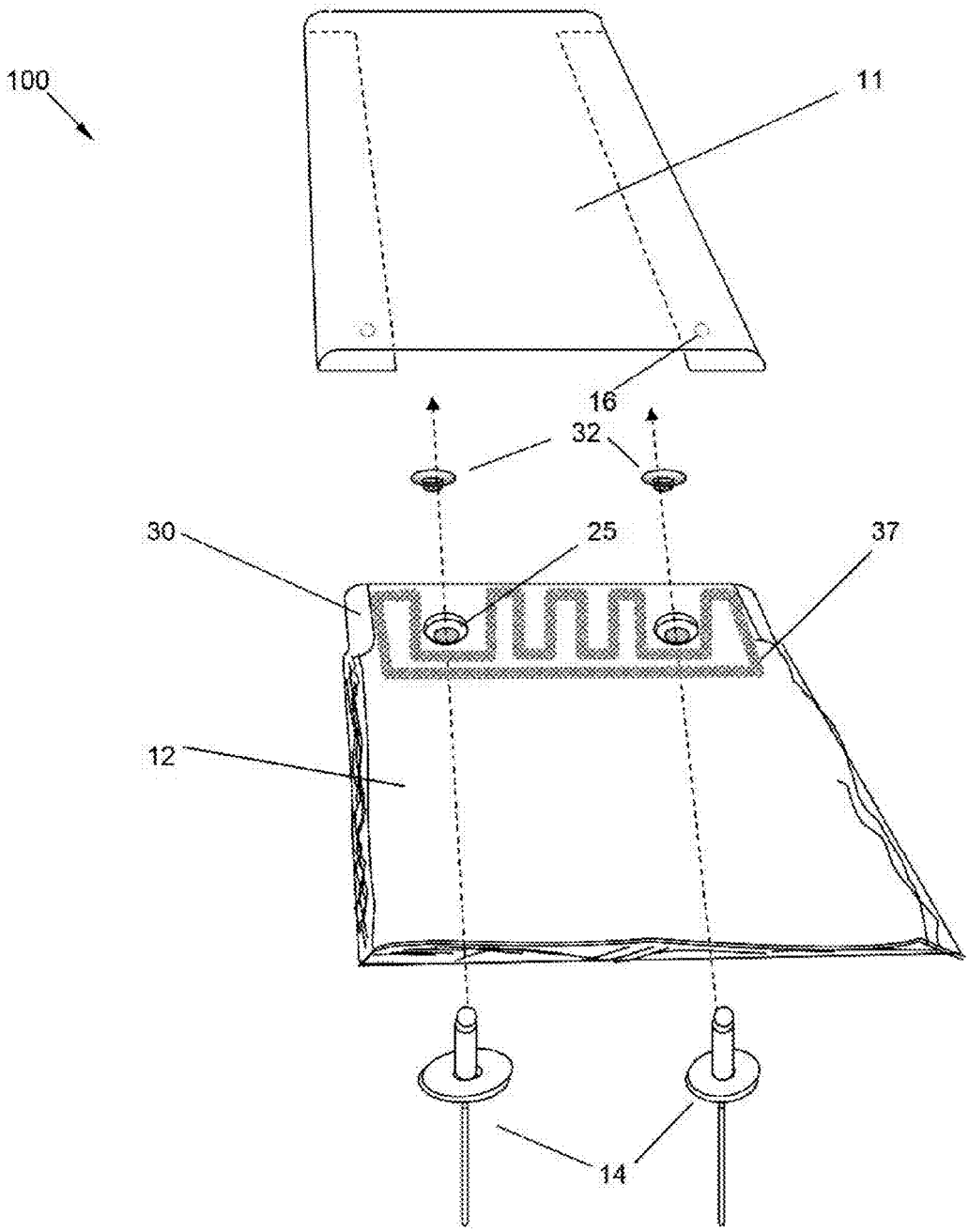
FIG. 24 is an exploded-view illustration of the LSA according to the principles of the present invention.
Figure 25:
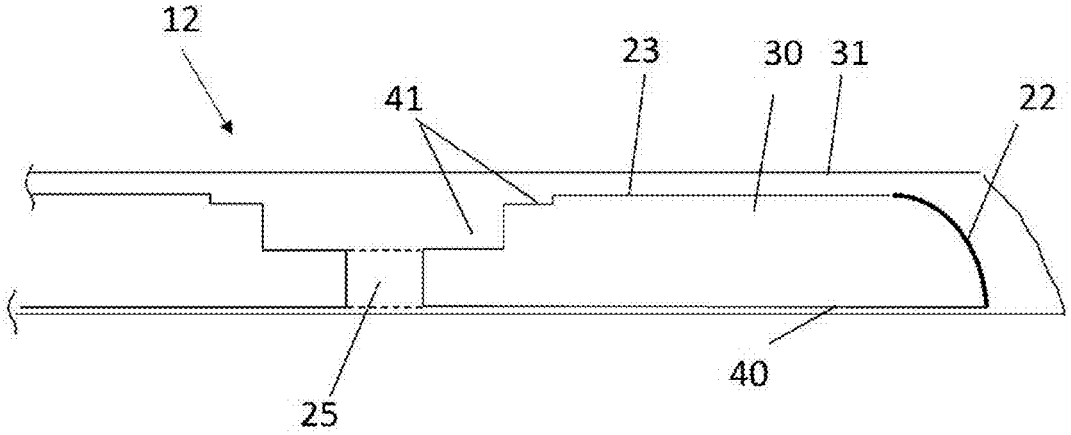
FIG. 25 is a cross-sectional view illustration, depicting a section through the shingle portion.

In one aspect and if the shingle portion 12 is formed of a moldable material (e.g., glass, clay, plastic, porcelain, etc.), then the shingle portion 12 can simply be molded and shaped into the desired shingle shape so that it securely fastens with the fastening portion. For example, the shingle portion 12 is described below with respect to FIG. 18 as having a connector section 30 and shingle section 31. If the shingle portion 12 is formed of a moldable material, then the connector section 30 can be molded into a desired shape securely attach with the fastening portion. Alternatively, some natural materials (and some synthetic materials if needed) require some shaping (through machining or otherwise) to allow for a stable shingle that securely fastens with the fastening portion. For example, if a stone or otherwise rough material, the shingle portion 12 is supplied with one or more rough or chipped edges, with the LSA 100 formed as follows:

a. In this aspect and as shown in FIG. 18, at least one end 21 is cut or processed to obtain a specified total slate length and become the top end of the shingle portion 12. The shingle portion can be cut using, for example, a circular water cooled diamond blade. Importantly, the shingle portion 12 includes a connector section 30 and shingle section 31. The connector section 30 is formed to securely attach with the fastening portion.

b. To form the connector section 30, the side edges 22 and the top 23 of the shingle portion 12 are then machined into a desired shape and size to fit securely against the fastening portion. As a non-limiting example, the surface of the shingle portion 12 is milled approximately two inches from the sawn edge a sufficient depth (e.g., less than one millimeter (mm)) to obtain a flat surface. Additionally, the side edges 22 are processed or machined to a specified width. For consistency amongst tiles, it is important to have a constant width and shape. As a non-limiting example, the machined sections of the shingle portion can be formed to have a constant width, minus ten mm (e.g., 25 centimeter (cm) slates will have a machined section of 240 mm, and 30 cm slates will have a machined section of 290 mm). The shingle portion 12 is machined using, for example, a water cooled surface grinder or diamond cup wheel that provides a suitable finish. While the top end 21 may be smooth, the bottom end 24, in one aspect, remains rough and natural looking as shown in FIGS. 18 and 19.

c. As shown in FIG. 20, attachment holes 25 are formed through the connector section 30 using any suitable mechanism or technique. As a non-limiting example, two attachment holes 25 are created (e.g., drilled) such that they are spaced at two inches less than the width (w) of the shingle portion 12. Further, the holes 25 are positioned one and a half inches down from the top end 21. In one aspect, the holes 25 are double countersunk to accommodate the offset washers as described further below. In another aspect, transitions 26 are cushioned or radiused (rounded) to eliminate stress at concentration points. Further and as shown in the top-view (attachment end) illustration of FIG. 21, the connector section 30 is inset from the remainder of the shingle portion (i.e., the shingle section 31). It should be noted that the dimensions depicted are for illustrative purposes as a single non-limiting example and that the invention is not intended to be limited thereto.

d. As noted above and as shown in FIG. 22, a spacer 32 can be desirably included. It should be noted that the spacer 32 can be of any material or design including an offset washer (as illustrated in FIG. 22), tapered, countersunk, or any design suitable for the disbursing of fastener hold down loads into and across the mating materials to accomplish binding while minimize fastening stresses.

e. FIG. 22 provides different view-point illustrations of a suitable spacer 32, a non-limiting example (and as depicted) of which is an offset washer. As will be understood below, the spacer 32 allows a fastener (e.g., a rivet 14, as shown in FIG. 23) to tighten against the shingle portion 12 without cracking the shingle portion 12. As understood by those skilled in the art and as shown in FIG. 23, a rivet 14 operates by crushing together a mandrel head 34 and a rivet head 35. In doing so, the spent mandrel 36 is sheared from the mandrel head 34 and an incredible amount of strength resides between the mandrel head 34 and rivet head 35 to affix any item therebetween.

f. During construction and as shown in FIG. 24, one or more spacers 32 are positioned within the holes 25 of the shingle portion 12.

g. Thereafter, an adhesive sealant 37 is desirably applied to the shingle portion 12. The adhesive sealant 37 is any suitable sealant device or solution, non-limiting examples of which include glue, tar, silicone, and sealant tap (e.g., foam).

h. The fastening portion 11 (e.g., aluminum attachment sheet) is then slid over the connector section 30 (machined edge) of the shingle portion 12 such that the holes 16 in the fastening portion 11 are aligned with the holes in the spacers 32.

i. A fastener is then used to fasten the fastening portion 11 against the shingle portion 12. The fastener is any attachment fastener or method that is operable for affixing two components against one another, non-limiting examples of which include all rivet types, screws, clips, or any means of fastening including mechanical materials and adhered methods utilizing adhesive glues, tape products, and magnetic fasteners. It should be understood that although a rivet 14 is illustrated as the fastener, the invention is not intended to be limited thereto as any suitable fastener can be employed. Nevertheless and as illustrated, rivets 14 are positioned in both holes from the rear or bottom surface of the LSA 100, through the spacers 32 and holes 16 in the fastening portion 11. The assembly 100 is adjusted to achieve proper alignment squareness and straightness.

j. Thereafter, the rivets 14 (or fastener) are fixed in place to securely fix the shingle portion 12 against the fastening portion 11. As can be appreciated, when fixing the rivets 14, an incredible amount of force is placed on the shingle portion 12. As noted above and to prevent the shingle portion 12 from cracking, the spacers 32 pass through the holes 25 in the shingle portion 12 such that the rivets 14 compression strength (when fixed and crushed) is largely born by the spacers 32.

k. Excess sealant 37 can then be removed using an acetone solvent or similar product or solution that is operable for removing excess sealant 37.

l. Although not required, desirably, an insulating support is added to the fastening portion 11. The insulating support is any suitable material that adds both insulating properties and support to the form of the fastening portion 11. In one aspect, the insulating support is also flexible so that the fastening portion 11 maintains some amount of flexibility. As a non-limiting example, the insulating support is a two pound density expanding polyurethane foam. The foam benefits include strength and increased insulating "R" value to the assembly. By including foam within the upper section (i.e., fastening portion 11) heat transfer between adjacent assembles is greatly reduced. Increased insulation value decreases heat energy transfer from the lower portion of the assembly (i.e., shingle portion 12) to adjacent tiles/assembly below. This provides for less heat transfer to the substrate below reducing building cooling requirements during high heat summer months. Contra to, the foam insulates energy transfer from the lower section to adjacent upper section reducing heat loss from within the structure during cooler evenings and winter months. In this example, the foam can be applied directly to the fastening portion 11, where it bonds and expands to fill the fastening portion 11. Once the foam is set, it can be easily trimmed as necessary (using a knife or any other suitable mechanism or device.

m. To prevent degradation of the foam (i.e., insulating support), a thin protective film sheet (e.g., plastic film) is applied over the exposed foam, rendering the LSA 100 ready for shipment and installation.

Figure 26:
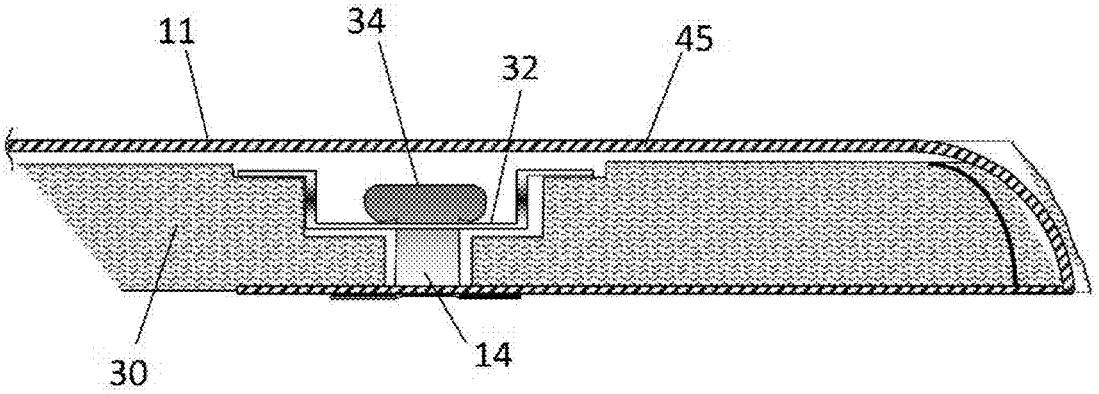
FIG. 26 is a cross-sectional view illustration, depicting a section the LSA as assembled and showing the shingle portion attached with the fastening portion; through the shingle portion.
Figure 27:
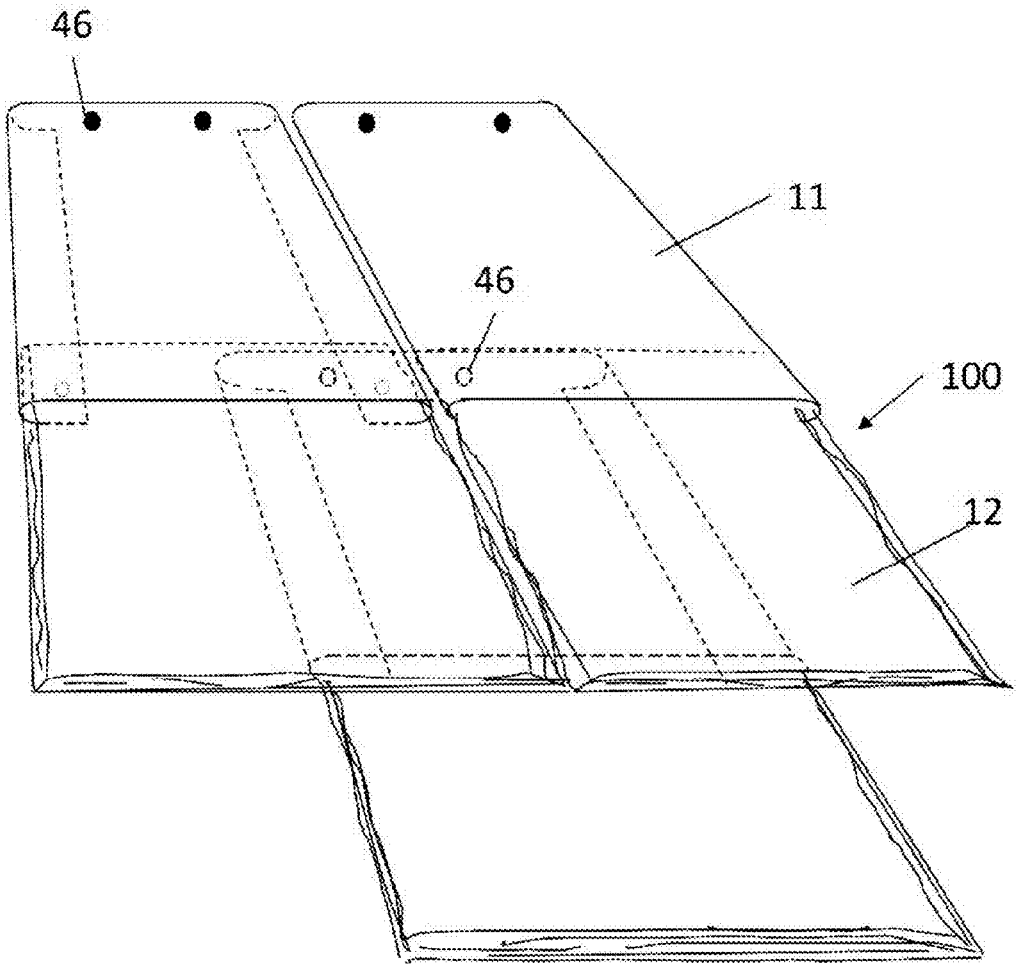
FIG. 27 is a front-view illustration, depicting several LSAs as installed on a roof.

As noted above, the shingle portion 12 can be counter sunk to accommodate the spacer or washer as needed. For example and as shown in the cross-sectional view of FIG. 26, the connector section 30 (of the shingle portion 12) has machined top 23, bottom 40 and side 22 edges so that it has a smaller height and width (in a cross-sectional profile) than the shingle section 31. This allows the fastening portion 11 to easily fasten with the shingle portion 12 without adding to the profile of the overall LSA. Also as shown, the hole 25 is double countersunk 41 to accommodate the offset washer. This aspect is further depicted in FIG. 27, which is a cross-sectional view of the attachment, showing the fastening portion 11 as slid over the connector section 30. Also shown is the spacer 32 (e.g., offset washer) with the rivet 14 passing therethrough. As shown, the crushed mandrel head 34 fits within the countersunk section and beneath the top surface 45 of the fastening portion 11. Thus, the top surface 45 of the fastening portion has no holes at the junction of connection with the shingle portion 12, thereby providing a sealed shingle assembly that is ready for installation.

For further understanding, FIG. 28 is an illustration depicting several LSA 100 as installed on a roof. During installation, a top section of the fastening portion 11 can be nailed 46 or otherwise adhered to the roof surface. A subsequent LSA 100 is then installed, with the shingle portion 12 then covering the nails 46 on the underlying fastening portion 11. Thus and as can be appreciated, the use of the fastening portion 11 provides a strong yet lightweight material that allows installation of the shingle portion 12 without all of the added weight of an entire slate shingle. It should be understood that all sizes, thicknesses, spacing, distances, and material compositions as listed herein are provided as non-limiting examples and that the invention can be modified as desired subject to material and application suitability. Further, the steps listed above are provided as example steps and can be altered as needed per the relevant material and application.

What is claimed is:

1. A lightweight shingle assembly, comprising:

a shingle portion;

a fastening portion affixed with the shingle portion, wherein the fastening portion is formed of a material that is dissimilar to a material forming the shingle portion;

wherein the shingle portion includes a connector section and a shingle section, such that each of the connector section and shingle section have a width and height profile, with the connector section having a width and height that is less than the width and height of the shingle section;

wherein the fastening portion is formed of an aluminum sheet, with fold-over sides that are adapted to wrap around the connector section of the shingle portion;

wherein double counter sunk holes are formed in the connector section;

wherein offset washers are positioned in the double counter sunk holes of the connector section; and wherein the fastening portion is affixed with the shingle portion with rivets that pass through holes in the fold-over sides and through the offset washers, whereby an installer can affix the fastening portion with a roof and thereby affix the shingle portion with the roof.

2. The lightweight shingle assembly as set forth in claim 1, wherein an insulating support is positioned within the fastening portion.

3. The lightweight shingle assembly as set forth in claim 2, wherein the insulating support is an expandable foam material.

4. The lightweight shingle assembly as set forth in claim 3, wherein the shingle portion is formed of a stone material.

* * * * *